US006164255A

United States Patent [19]

Maas et al.

[11] Patent Number: 6,164,255

[45] Date of Patent: Dec. 26, 2000

[54] SWITCHABLE CAM FOLLOWER

[75] Inventors: Gerhard Maas, Furth; Oliver Schnell; Michael Haas, both of Weisendorf, all of Germany

[73] Assignee: Ina Walzlager Schaeffler oHG, Germany

[21] Appl. No.: 09/401,904

[22] Filed: Sep. 23, 1999

[30] Foreign Application Priority Data

Sep. 26, 1998 [DE] Germany ..... 198 44 202

[51] Int. Cl.[7] ..... F01L 1/14

[52] U.S. Cl. ..... 123/90.16; 123/90.5; 123/90.55; 123/198 F

[58] Field of Search ..... 123/90.15, 90.16, 123/90.48, 90.49, 90.5, 90.55, 198 F

[56] References Cited

U.S. PATENT DOCUMENTS

| | | | |
|---|---|---|---|
| 5,253,621 | 10/1993 | Dopson et al. | 123/90.16 |
| 5,361,733 | 11/1994 | Spath et al. | 123/90.16 |
| 5,398,648 | 3/1995 | Spath et al. | 123/90.16 |
| 5,402,756 | 4/1995 | Bohme et al. | 123/90.16 |
| 5,431,133 | 7/1995 | Spath et al. | 123/90.16 |
| 5,615,651 | 4/1997 | Miyachi | 123/198 F |
| 5,782,216 | 7/1998 | Haas et al. | 123/90.16 |
| 5,934,232 | 8/1999 | Greene et al. | 123/90.16 |
| 6,053,133 | 4/2000 | Faria et al. | 123/90.16 |

FOREIGN PATENT DOCUMENTS

| | | |
|---|---|---|
| 4238325 | 5/1994 | Germany . |
| 9403420 | 6/1994 | Germany . |
| 9645964 | 5/1998 | Germany . |
| 61118514 | 6/1986 | Japan . |
| 7127410 | 5/1995 | Japan . |
| 9264113 | 10/1997 | Japan . |
| 9530081 | 11/1995 | WIPO . |

*Primary Examiner*—Weilun Lo
*Attorney, Agent, or Firm*—Bierman, Muserlian and Lucas

[57] ABSTRACT

A switchable cam follower (1) for a valve train (1*b*) of an internal combustion engine (1*c*) which is indirectly actuatable via tappet push rods (1*a*), the cam follower (1) comprising an outer section (2) which encloses an inner section (4) that is axially movable relative thereto, the outer section (2) having a pot-shaped configuration with a bottom (6) which comprises an end (5) for cam contact and separates the inner section (4) from a cam (4*a*) whereby upon coupling of the sections (2, 4) by a coupling means (23), a high lift of a gas exchange valve (22*a*) is effected, and upon uncoupling of the sections (2, 4), a zero lift, the cam follower (1) having a relatively simple structure with only a small design space requirement and can be installed in receptions (20*a*) of the internal combustion engine (1*c*) as provided hitherto for non-switchable cam followers.

12 Claims, 2 Drawing Sheets

SWITCHABLE CAM FOLLOWER

FIELD OF THE INVENTION

A switchable cam follower for a valve train of an internal combustion engine, which valve train is indirectly actuatable via tappet push rods, said cam follower having the following features:

- the cam follower can be installed in driving relationship between a camshaft and one end of a tappet push rod, said cam follower comprising an outer and an inner section as well as a coupling means,
- the outer section can be inserted with an outer peripheral surface thereof into a reception of the internal combustion engine and possesses on an end facing the camshaft a contacting surface for at least one cam of the camshaft,
- the inner section in a recess of the outer section, is axially movable relative to the outer section and has on an end facing away from the camshaft, a support for said one end of the tappet push rod, and
- said inner and outer sections being coupled to each other by the coupling means for achieving a high lift of at least one gas exchange valve of the valve train.

BACKGROUND OF THE INVENTION

A cam follower of the pre-cited type is known from U.S. Pat. No. 5,361,733 and this cam follower likewise comprises an outer and an inner section. However, the outer section is configured to be contacted by high lift cams and the inner section, by a low lift cam. Due to this configuration, the cam follower has a relatively large mass which has a negative effect on the oscillating masses in the valve train even in the uncoupled state. At the same time, the cam follower has a relatively large overall width. Moreover, a set of three cams is required for each cam follower which, in turn, unnecessarily increases the costs of valve actuation on the whole.

OBJECTS OF THE INVENTION

It is an object of the invention to provide a switchable cam follower of the type described above in which the mentioned drawbacks are eliminated.

This and other objects and advantages of the invention will become obvious from the following detailed description.

SUMMARY OF THE INVENTION

The invention achieves the above objects by the fact that the outer section is pot-shaped and has a bottom which comprises the end having the contacting surface for the cam and separates the inner section from the cam, and the cam follower is configured so that the high lift of the gas exchange valve is effected upon coupling of the inner and outer sections by the coupling means, and a zero lift of the gas exchange valve is effected upon uncoupling of the inner and outer sections.

By these inventive measures, a cam follower of a simple structure is created which eliminates the aforementioned drawbacks. Since it possesses only a relatively small mass, the oscillating masses are effectively reduced even during its operation in the uncoupled state. At the same time, the cam follower of the invention has only a small space requirement in diameter direction. In addition, the associated camshafts can have a much simpler configuration than in the cited prior art because only one cam is required per cam follower.

The cam follower is preferably intended for valve trains which can be completely deactivated. However, a use of the inventive cam follower is also conceivable for obtaining only partial lifts. This is achieved in that the inner section then does not perform any complete "idle stroke" relative to the outer section.

A further advantage of the invention is that it provides a relatively simple means for the supply of hydraulic medium to the cam follower and a further transport of the hydraulic medium directly to the coupling means is likewise achieved in a simple manner. The coupling means which is configured as a slide or a piston is displaced in its uncoupling direction, preferably by a hydraulic medium, and in coupling direction by a displacing means such as a compression spring. It is proposed to position the coupling means in its uncoupled state in a reception of the inner section of the cam follower. But the coupling means may also be arranged in its uncoupled state in a reception of the outer section and then be displaced radially inwards for coupling.

It is further possible to effect a displacement of the coupling means in both directions by hydraulic medium. It is further conceivable and within the scope of the invention to displace the coupling means in its uncoupling direction by the force of a displacing means such as a compression spring and in the coupling direction by hydraulic medium pressure or another servo means.

According to a further feature of the invention, a compression spring means is arranged between a camshaft-proximate end of the inner section and the bottom of the outer section. This compression spring means guarantees a constant support of the cam follower between the cam and an end of the tappet push rod.

At the same time, in the uncoupled state of the cam follower with running off cam flank, the spring means displaces the inner section into its axially distant position relative to the outer section so that the coupled state of the cam follower can be established.

Although the invention proposes a coupling means made as a slide or a piston, it is equally conceivable to use configurations such as wedges, balls or the like.

Alternatively to the proposed radial or secant-like positioning of the receptions for the coupling means, these receptions may also extend obliquely or askew or in any similar manner.

The invention further proposes a plug to serve as a support for the displacing means on its end remote from the coupling means, and this plug is arranged in the reception of the inner section. The plug may have a cup-shaped configuration or may be made as a simple annular element. Another possibility is to have a stop means extend radially inwards from the reception and form a support for the displacing means.

To assure a positional correspondence of the receptions for the coupling means in the inner and outer sections, it is necessary to provide an anti-rotation means between the two sections. The invention proposes a piston which is fixed in a part of the reception of the outer section diametrically opposite the part of the reception of the outer section into which the coupling means can be displaced for coupling. This piston communicates with a longitudinal groove on the outer peripheral surface of the inner section. However, it is also conceivable to arrange the piston or locking element on the outer peripheral surface of the inner section and the longitudinal groove within the reception of the outer section. It is obvious that it is also possible for this purpose to use flattened portions or similar anti-rotation means in the region of an annular surface between the sections.

The sections preferably have a cylindrical configuration but other geometries deviating from the cylindrical shape, for example four-edged shapes or the like, are also possible. Advantageously, the reception for the coupling means in the inner section is arranged in the region of the end of the inner section facing the camshaft. This is particularly recommended when it is intended to install a hydraulic clearance compensation element in the inner section.

To prevent an unnecessary "pumping-up" of the cam follower during its uncoupled state, it is proposed to provide at least one deaeration bore through the outer section. Advantageously, this bore is arranged axially between the bottom of the outer section and the end of the inner section facing the camshaft. In this way, the air displaced during an axial movement of the inner section relative to the outer section can escape quite simply into the open.

A particularly low-friction cam follower is obtained if the contacting surface for the cam on the outer section is made as a rotatable and, if desired, rolling bearing-mounted roller. This is a further contribution to a reduction of friction in the valve train. A simple means for fixing a pin for mounting the roller is a swaging or a press fit in a corresponding bore of the outer section. If the aforementioned hydraulic clearance compensation element is provided, there is no need for mechanical clearance adjusting measures.

As a simple axial stroke limiter of the coupling means in the radially outward direction, it is proposed to use a locking element such as a snap ring which surrounds the coupling means in the region of its outer end face. This locking element thus not only serves as a security device during transportation but also prevents the coupling means from being undesirably displaced into the channel through which hydraulic medium is supplied thereto. The split ends of the snap ring clasp the piston which constitutes the anti-rotation means between the inner and the outer section, so that this piston is also prevented from rotating.

The invention will now be described more closely with reference to the drawings.

DETAILED DESCRIPTION OF THE DRAWINGS

Figure 1:
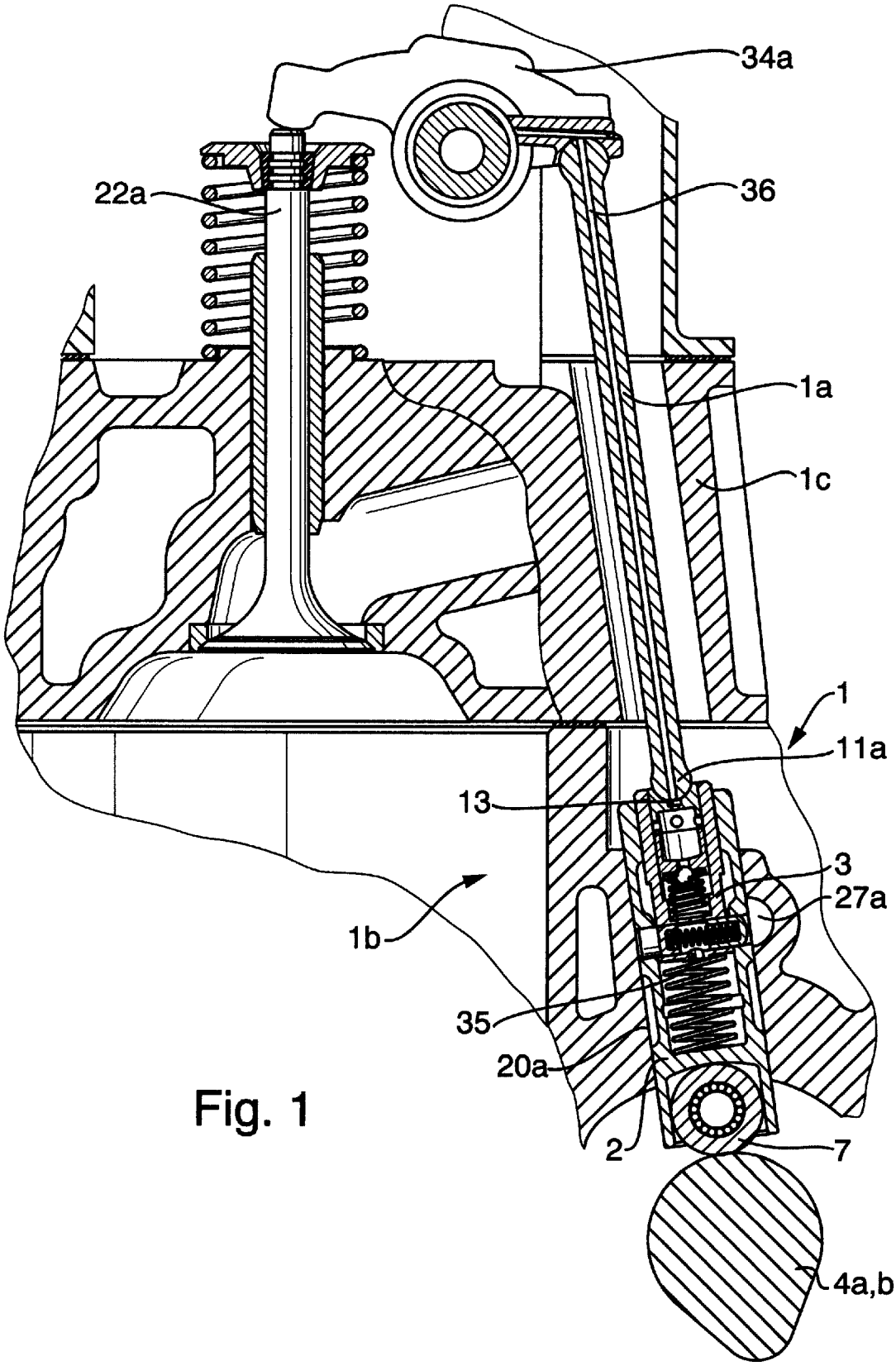
FIG. 1 is a cross-section through an internal combustion engine having a cam follower of the invention.

FIG. 1 discloses a switchable cam follower 1 which can be installed in a valve train 1*b* of an internal combustion engine 1*c* which is indirectly actuatable via tappet push rods 1*a*. As shown more clearly in FIG. 2, the cam follower 1 comprises an outer cylindrical section 2 which encloses in its recess 3, a cylindrical section 4 which section 4 is axially movable relative to the section 2.

At its end 5 facing a cam 4*a* of a camshaft 4*b* (see also FIG. 1), the outer section 2 is closed by a bottom 6. For a direct contact with the cam 4*a*, a roller 7 forming a contacting surface 8 is provided in the region of the bottom 6 which roller is supported through a rolling bearing 9 on a pin 10. The pin 10 is introduced diametrically through the region of the bottom 6 of the outer section 2 and its ends are fixed in the outer section 2 by a swaging 11.

In the region of its end 12 facing an end 11*a* of the tappet push rod 1*a*, the inner section 4 comprises a support 13, in the present case in the form of a semi-spherical depression, for the end 11*a* of the tappet push rod 1*a*. This support 13 is integrally formed in a pressure piston 14 of a clearance compensation element 15 which is thus a direct structural component of the inner section 4. In the region of its end 16 facing the camshaft 4*b*, the inner section 4 comprises a bottom 17. Between this bottom 17 and the bottom 6 of the outer section 2, there extends a compression spring means 18 which, in this case, is made up of two compression springs which bias the inner section 4 in a direction leading out of the recess of the outer section 4.

Figure 2:
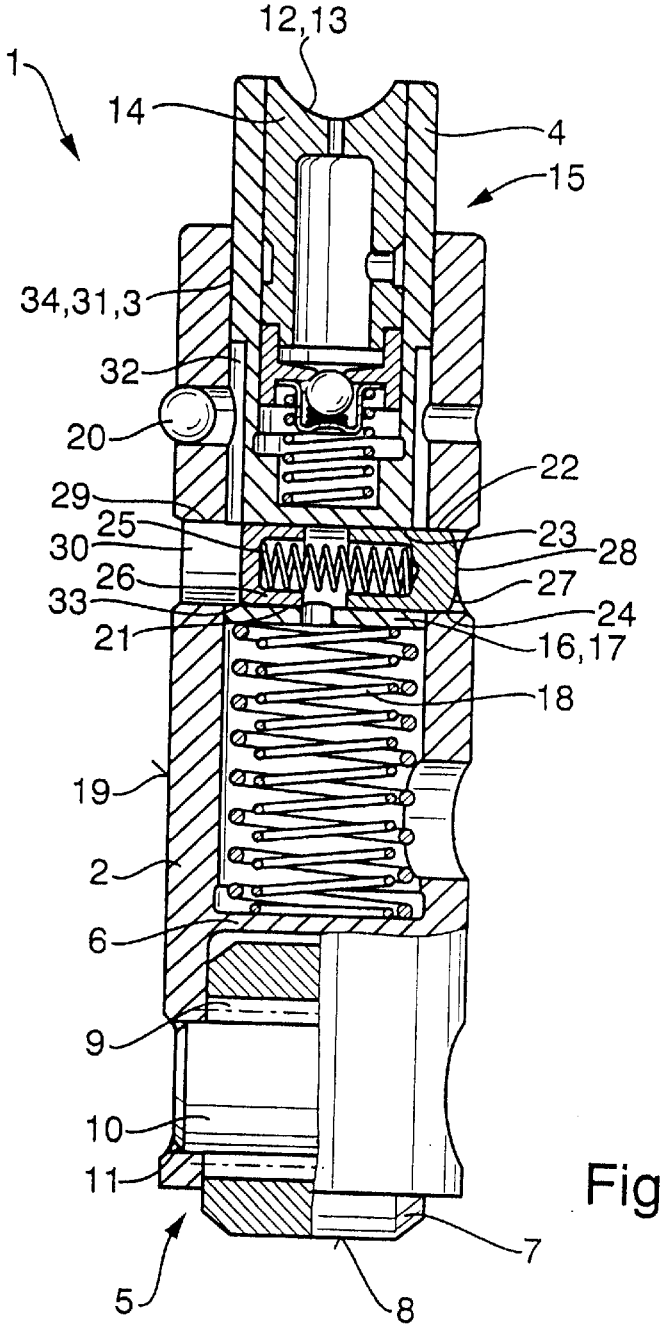
FIG. 2 is an enlarged detail from FIG. 1 showing a longitudinal section through the cam follower.

A person skilled in the art will at the same time recognize in FIG. 2 that a body 20 is arranged in the region of an outer peripheral surface 19 of the outer section 4. This body 20 extends radially outwards beyond the outer peripheral surface 19 and serves as an anti-rotation device for the entire cam follower 1 relative to its reception 20*a* in the internal combustion engine 1*c*. In the present case, the body 20 is a rolling element such as a ball which ball is, for instance, pressed into a corresponding recess of the outer section 2. It is possible to replace this ball with a roller, a rivet or any other suitable, protruding body. Alternatively, a flattened portion or the like may be arranged on the outer section to cooperate with a corresponding coutersurface on the surrounding material.

A radially continuous reception 21 extends in the region of the bottom 17 of the inner section 4. In the present case, this reception 21 is made as a bore. A further reception 22 made as a through-bore is provided in the outer section 2. The receptions 21 and 22 are aligned to each other during a base circle contact of the cam 4*a* in the axially extended state of the sections 2, 4 relative to each other. The coupling of the cam follower 1 for achieving a high lift of a gas exchange valve 22*a* can be effected during this state.

A coupling means 23 is arranged in the reception 21 of the inner section 4 for displacement in reception direction. The coupling means 23 in the present example is a piston-like slide. The coupling means 23 is biased radially outwards, i.e. towards a part 24 of the reception 22 of the outer section 2 by a displacing means 25 in the form of a compression spring which displacing means 25 is supported at its end remote from the coupling means 23 on a plug 26 which is fixed in the reception 21.

Figure 3:
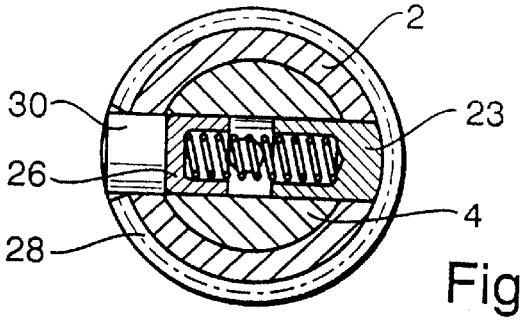
FIG. 3 is a cross-section through the cam follower of the invention taken in the region of its coupling means.

Hydraulic medium can be conveyed to an outer end face 27 of the coupling means 23 through a channel 27*a* (see also FIG. 1) arranged in the reception 20*a* of the internal combustion engine 1*c*. This channel 27*a* is aligned to the end face 27 at least in a base circle phase of the cam follower 1. The person skilled in the art can additionally see in FIG. 3, in conjunction with FIG. 2, that the outer end face 27 of the coupling means 23 is delimited by a retaining element 28. In the present embodiment, this retaining element 28 is made as a snap ring and surrounds the outer peripheral surface 19 of the outer section 2 at the level of the displacing means 25. In this way, the displacing means 25 is prevented from undesirably moving towards the channel 27*a* of the reception 20*a*. At the same time, the retaining element 28 also serves as a security device during transportation.

A part 29 situated diametrically opposite the part 24 of the reception 22 comprises an anti-rotation means 30 in the form of a piston which extends radially inwards into the recess 3. An outer peripheral surface 31 of the inner section 4 comprises on the side of the anti-rotation device 30, a longitudinal groove 32 into which the anti-rotation device 30 projects. The longitudinal groove 32 is at least so long that an unobstructed displacement of the inner section 4 relative to the outer section 2 is possible in the uncoupled state of the cam follower 1.

A stop for limiting the axial movement of the inner section 4 away from the outer section 2 is provided on the bottom 17 of the inner section 4. The plug 26 is aligned to a bottom of the longitudinal groove 32, and on the side of the anti-rotation device 30, the bottom 17 of the inner section 4 comprises a projection 33 which extends up to the recess 3. In this way, an excellent positional correspondence of the receptions 22, 21 to each other is effected in the base circle of the cam 4*a* for establishing the coupled state of the cam follower 1.

As the person skilled in the art will recognize, the cam follower 1 is represented in FIG. 1 in its coupled state. A portion of the coupling means 23 overlaps an annular surface 34 between the sections 2, 4 and has been displaced by the force of the displacing means 25 partly into the reception 22 of the outer section 2. In this way, a mechanical connection is formed between the outer section 2 and the inner section 4. Upon cam lift, the cam follower 1 and thus also, indirectly, the tappet push rod 1*a*, a rocker arm 34*a* and the gas exchange valve 22*a* follow the contour of the cam 4*a* (see also FIG. 1).

If it is desired to switch off the gas exchange valve 22*a*, hydraulic medium is conveyed from the channel 27*a* to the outer end face 27 of the coupling means 23. If the cam follower 1 is in its base circle phase, in which the sections 2, 4 are not restrained against each other, the coupling means 23 can be displaced by an adequate hydraulic medium pressure, against the force of its displacing means 25, radially inwards completely into its reception 21 in the inner section 4. With the next cam lift, the outer section 2 is displaced relative to the inner section 4 against the force of the compression spring means 18. The tappet push rod 1*a* and, consequently, the gas exchange valve 22*a* remain unloaded.

If a coupling of the sections 2, 4 is desired, the hydraulic medium pressure in front of the outer end face 27 of the coupling means 23 is reduced—again in the base circle phase and thus in the extended condition of the sections 2, 4 relative to each other—to such an extent that the force of the displacing means 25 suffices to displace the coupling means 23 partly into the reception 22.

To prevent an undesired "pumping-up" of the cam follower 1 in its uncoupled state, the outer section 2 comprises, axially beneath the bottom 17 of the inner section 4, a deaeration bore 35 leading into the open. A duct 36 for the supply of hydraulic medium to the initially described clearance compensation element 15 is arranged in the tappet push rod 1*a*, but it is also conceivable to arrange a duct in the reception 20*a* of the internal combustion engine 1*c*.

Various modifications of the cam follower of the invention may be made without departing from the spirit or scope thereof and it is to be understood that the invention is intended to be limited only as defined in the appended claims.

What we claim is:

1. A switchable cam follower for a valve train of an internal combustion engine, which valve train is indirectly actuatable via tappet push rods, said cam follower having the following features:

the cam follower is installed in driving relationship between a camshaft and one end of a tappet push rod and comprises an outer and an inner section as well as a coupling means, the outer section is inserted with an outer peripheral surface thereof into a reception of the internal combustion engine and possesses on an end facing the camshaft, a contacting surface for at least one cam of the camshaft, the inner section is mounted in a recess of the outer section, is axially moveable relative to the outer section and has on an end facing away from the camshaft, a support for said one end of the tappet push rod, said inner and outer sections can be coupled to each other by the coupling means for achieving a high lift of at least one gas exchange valve of the valve train, the outer section is pot-shaped and has a bottom which comprises the end having the contacting surface for the cam and separates the inner section from the cam, and the cam follower is configured so that the high lift of the gas exchange valve is effected upon coupling of the inner and outer sections by the coupling means, and a zero lift of the gas exchange valve is effected upon uncoupling of the inner and the outer sections, at least one compression spring means is arranged between a camshaft-proximate end of the inner section and the bottom of the outer section, each of the sections comprises a reception extending radially, which receptions are aligned to each other in an uncoupled state of the sections when the cam is in base circle contact with the cam follower, the coupling means is made as at least one slide which extends in one of the receptions and which, for coupling the sections, is displaceable by a displacing means towards the other of the receptions so as to overlap an annular surface between the sections, and an anti-rotation means is arranged between the sections, the anti-rotation means is a locking element which is fixed in a part of the reception of the outer section diametrically opposite another part of the reception of the outer section into which the coupling means can be displaced for coupling, and the anti-rotation means projects into the recess of the outer section, and an outer peripheral surface of the inner section comprises on a side of the anti-rotation means, a longitudinal groove in which the anti-rotation means is guided.

2. A cam follower of claim 1 wherein a hydraulic clearance compensation element is installed in the inner section, a pressure piston of the hydraulic clearance compensation element comprises the support for the end of the tappet push rod, and the support is configured as a semi-spherical depression.

3. A cam follower of claim 1 wherein in the uncoupled state of the sections, the coupling means extends in the reception of the inner section, and for coupling the sections, the coupling means is displaced towards the reception of the outer section by a force of the displacing means which is configured as at least one compression spring, and the reception in the outer section has a continuous configuration, and a servo means can be conveyed to an outer end face of the coupling means in the outer section to effect a re-positioning of the coupling means against the force of the displacing means for uncoupling the sections.

4. A cam follower of claim 3 wherein the servo means is a hydraulic medium.

5. A cam follower of claim 3 wherein the displacing means is supported at an end thereof remote from the coupling means on a plug fixed in the reception of the inner section.

6. A cam follower of claim 3 wherein the coupling means is delimited radially outwardly by a retaining element made as a snap ring which surrounds the outer peripheral surface of the outer section, and split ends of the snap ring clasp the anti-rotation means.

7. A cam follower of claim 1 wherein the locking element is a piston.

8. A cam follower of claim 1 wherein the reception of the inner section is situated in a region of the camshaft-proximate end of the inner section.

9. A cam follower of claim 1 wherein at least one deaeration bore leads out of a space defined by the outer section, the bottom of the outer section and the camshaft-proximate end of the inner section into the open.

10. A cam follower of claim 1 wherein the contacting surface of the outer section for the cam is configured as a rotatable roller which is supported on a rolling bearing and mounted on a pin fixed in the outer section by a swaging, and the outer section comprises a radially projecting body serving as an anti-rotation device relative to the reception of the internal combustion engine, or an anti-rotation surface is provided on the outer section.

11. A cam follower of claim 10 wherein the radially projecting body is a rolling element or a rivet or an extension.

12. A cam follower of claim 6 wherein the locking element is a piston.

* * * * *